US006484725B1

(12) United States Patent
Chi

(10) Patent No.: US 6,484,725 B1
(45) Date of Patent: Nov. 26, 2002

(54) NOSE PLUG DEVICE HAVING AIR BREATHING STRUCTURE

(76) Inventor: Min Hung Chi, No. 230, Yien Hai 1st Road, Hsiau Gang Chu, Kaoshiung (TW), 812

( * ) Notice: Subject to any disclaimer, the term of this patent is extended or adjusted under 35 U.S.C. 154(b) by 7 days.

(21) Appl. No.: 09/888,030

(22) Filed: Jun. 25, 2001

(51) Int. Cl.[7] ..... A61F 9/00
(52) U.S. Cl. ..... 128/858; 128/206.11; 128/207.18
(58) Field of Search ..... 128/206.11, 858, 128/201.18, 201.23, 203.18, 203.22, 204.12, 206.18, 206.28, 207.13, 207.18, 204.11

(56) References Cited

U.S. PATENT DOCUMENTS 1,278,342 A * 9/1918 Heimberg ..... 128/203.22
4,996,983 A * 3/1991 AmRhein ..... 128/206.11
5,425,359 A * 6/1995 Liou ..... 128/206.11
6,027,470 A * 2/2000 Mendius ..... 604/8

* cited by examiner

*Primary Examiner*—Michael A. Brown
*Assistant Examiner*—Lalita M. Hamilton
(74) *Attorney, Agent, or Firm*—Charles E. Baxley

(57) ABSTRACT

A nose plug device includes one or two elongate members for engaging into the nostrils of the nose of a user. The elongate members each includes a check valve for allowing air to flow out of the elongate member and for preventing air or water from entering into the elongate member. The check valves each includes a forwardly curved or convex membrane having a slit for forming the check valve. The elongate members each has one or more peripheral flanges for engaging with the nose and for making a water tight seal with the nose and for securing the elongate members in the nose.

2 Claims, 4 Drawing Sheets

NOSE PLUG DEVICE HAVING AIR BREATHING STRUCTURE

BACKGROUND OF THE INVENTION

1. Field of the Invention

The present invention relates to a plug, and more particularly to a nose plug device having a structure for allowing the users to breathe in or under water.

2. Description of the Prior Art

Typical nose plug devices may be used for engaging into the noses of the users. However, when the nose plug devices are engaged into the noses, the users may not breathe in or under the water; i.e., the air may not flow into and out through the nose plug devices. The water may thus be prevented from flowing into the nose of the user via the nose plug device. However, the air also may not be forced to flow out of the nose plug device by the users, such that the users may not feel comfortable.

The present invention has arisen to mitigate and/or obviate the afore-described disadvantages of the conventional nose plug devices.

SUMMARY OF THE INVENTION

The primary objective of the present invention is to provide a nose plug device having a structure for allowing the users to breathe in or under water, and for preventing the water from entering into the nose via the nose plug device.

In accordance with one aspect of the invention, there is provided a nose plug device comprising one or two elongate members for engaging into nostrils of a nose of a user, and the elongate members each including a check valve provided therein for allowing air to flow out of the elongate member and for preventing air and water from entering into the nose of the user via the elongate members.

The check valves each includes a membrane provided therein and having a slit formed therein. The membranes are preferably convex and curved forwardly of the elongate members respectively for forming a suitable resilience to the membranes of the check valves.

The elongate members each includes at least one peripheral flange extended radially outward therefrom for engaging with the nose and for making a water tight seal with the nose.

A device is further provided for coupling the elongate members together. The elongate members each includes a front portion, the coupling device includes a coupler coupled between the front portions of the elongate members. The coupling device may also be used to prevent the elongate members from being deeply engaged into the nose of the user.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
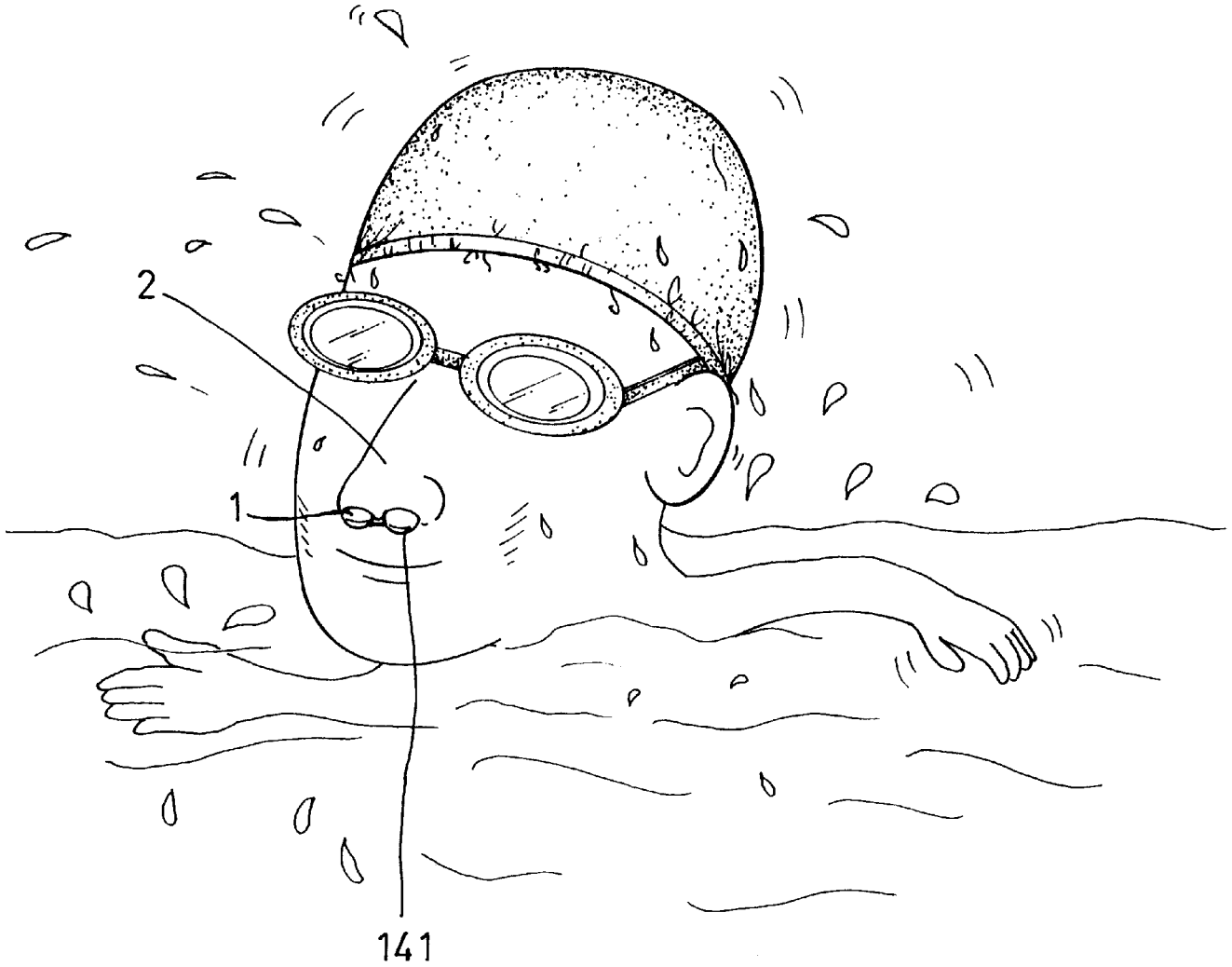
FIG. 1 is a perspective view illustrating the attachment of a nose plug device in accordance with the present invention into the noses of the user.
Figure 2:
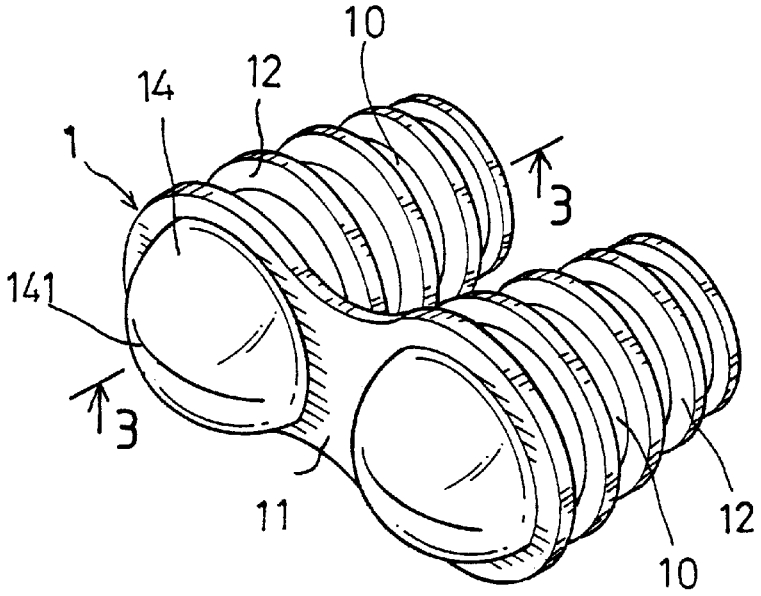
FIG. 2 is a perspective view of the nose plug device.
Figure 3:
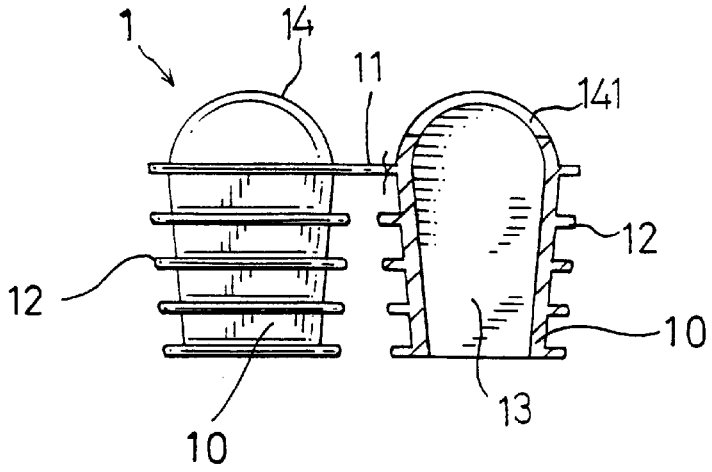
FIG. 3 is a partial cross sectional view taken along lines 3—3 of FIG. 2.

Referring to the drawings, and initially to FIGS. 1–3, a nose plug device 1 in accordance with the present invention is provided for engaging into the nose 2 of the users (FIG. 1). For example, the nose plug device comprises two elongate members 10 for engaging into the nostrils 21 of the nose 2 respectively, best shown in FIGS. 6, 7. The elongate members 10 each preferably includes one or more peripheral flanges 12 extended radially outward therefrom for engaging with the nose 2 and for making a water tight seal with the nose 2. A coupler 11 is preferably provided and coupled between the front portions of the elongate members 10, for coupling the elongate members 10 together, and for preventing the elongate members 10 from being deeply engaged into the nose 2.

Figure 5:
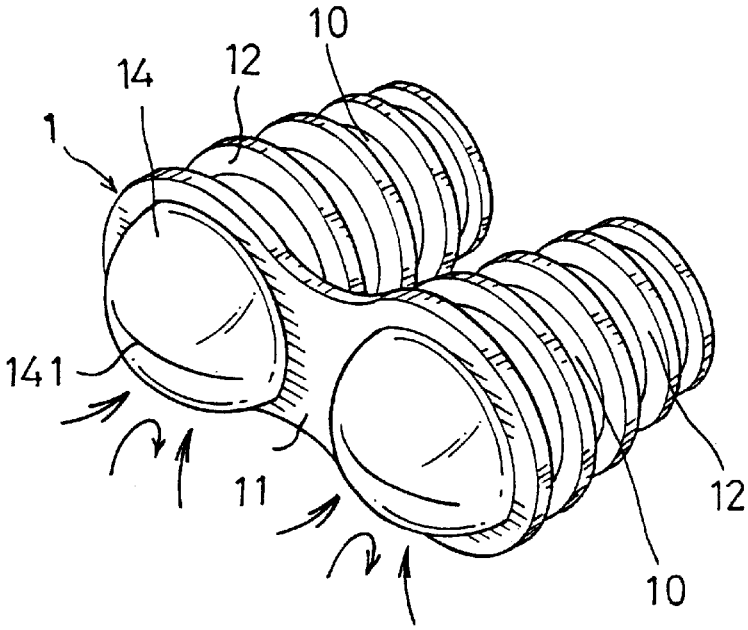
FIGS. 4 and 5 are perspective views similar to FIG. 2, illustrating the operation of the nose plug device.

The elongate members 10 of the nose plug device 1 each includes a chamber 13 formed therein, and each includes a check valve 14 provided therein, such as provided in the front portion thereof. For example, the check valves 14 each includes a convex or outwardly or forwardly curved membrane structure having a slit 141 formed therein, particularly formed in the middle portion thereof. The elongate member 10, particularly the peripheral flanges 12 of the elongate members 10 and/or the check valves 14 are preferably made of silicone, rubber, gel materials or the like that includes a suitable resilience for clamping the elongate members 10 within the nostrils 21 of the nose 2, and for allowing the slits 141 of the check valves 14 to be opened when air flows out through the check valves 14 (FIGS. 4, 6) and to be closed when air is going to flow into the nose 2 (FIGS. 5, 7).

Figure 4:
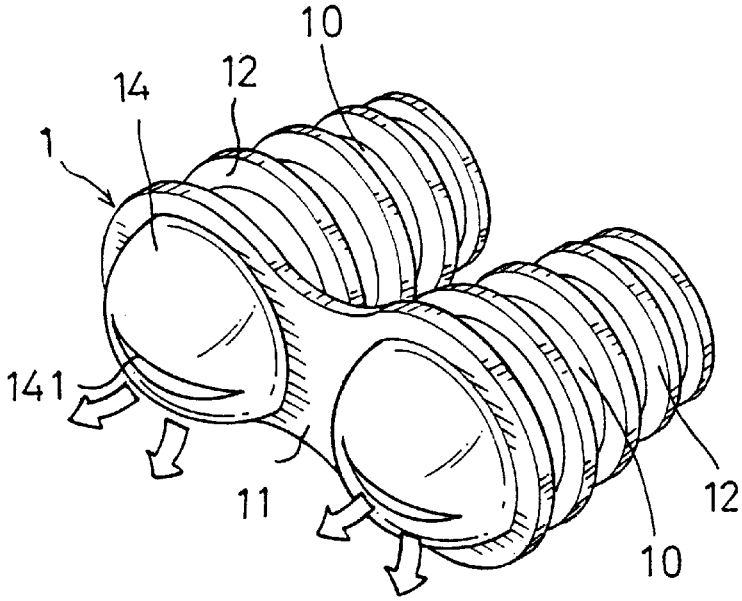
Figure 6:
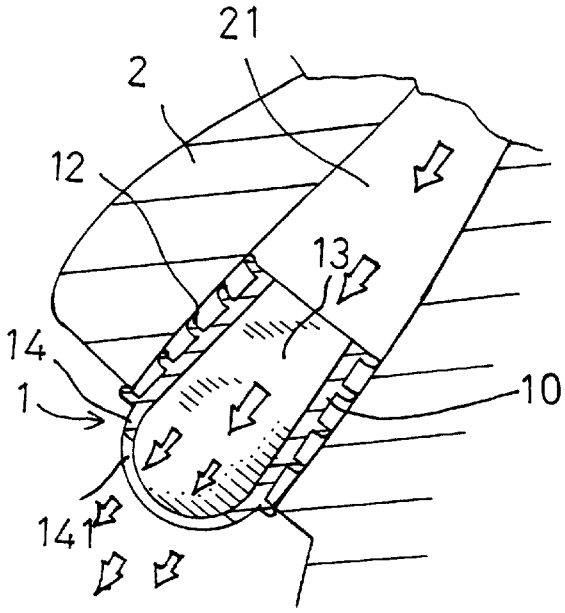
FIGS. 6 and 7 are partial cross sectional views illustrating the operation of the nose plug device.
Figure 7:
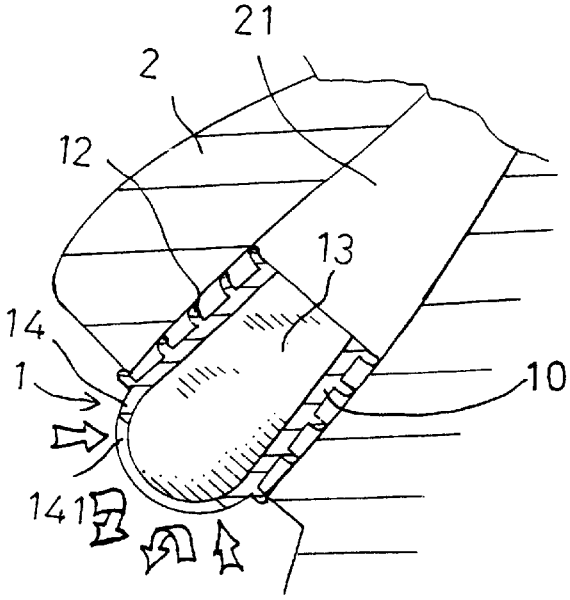

In operation, as shown in FIGS. 4, 6, the slits 141 of the check valves 14 of the nose plug device may be opened when the users breathe the air or force the air to flow out of the elongate members 10. As shown in FIGS. 5 and 7, when the user is not breathing or does not force the air to flow out of the elongate members 10, the check valves 14 may be enclosed, for preventing the water from flowing into the nose 2 of the user from outer environment or from the swimming pool. The water may thus be prevented from entering into the nose 2 of the users by the nose plug device.

Accordingly, the nose plug device in accordance with the present invention includes a structure for allowing the users to breathe in or under water.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A nose plug device comprising:

two elongate members for engaging into nostrils of a nose of a user, and said elongate members each including at least one peripheral flange extended radially outward therefrom for engaging with and for making a water tight seal with the nose of the user, said elongate members each including a check valve provided therein for allowing air to flow out of said elongate member and for preventing air from entering into said elongate member, said check valves each including a resilient membrane provided therein and convex and curved forwardly of said elongate members respectively and having a slit formed therein, said slit of said resilient membrane being provided and closed for blocking air from entering into said elongate members, and said slit of said resilient membrane being opened when air flows out through said elongate members, and means for coupling said elongate members together.

2. The nose plug device according to claim 1, wherein said elongate members each includes a front portion, said coupling means includes a coupler coupled between said front portions of said elongate members, for allowing said elongate members to be fully engaged into the nose of the user.

* * * * *